United States Patent [19]

Anderson

[11] Patent Number: 4,613,131

[45] Date of Patent: Sep. 23, 1986

[54] EXERCISE DEVICE FOR PHYSICAL THERAPY

[76] Inventor: Erma N. Anderson, 21025 Victor St., Apt. 7, Torrance, Calif. 90503

[21] Appl. No.: 801,830

[22] Filed: Nov. 26, 1985

Related U.S. Application Data

[63] Continuation-in-part of Ser. No. 458,743, Mar. 2, 1983, abandoned.

[51] Int. Cl.[4] ..... A63B 23/04; A63G 11/00; A63H 1/16

[52] U.S. Cl. ..... 272/146; 441/65; 441/67; 272/56; 272/1 B; 272/33 A

[58] Field of Search ..... 272/33 A, 56, 114, 115, 272/93, 1 B, 146, 46, 28 R, 47; 273/128, 424; 280/12 B; 441/65, 67; 114/346

[56] References Cited

U.S. PATENT DOCUMENTS

| | | | |
|---|---|---|---|
| D. 255,820 | 7/1980 | Borden et al. | 441/65 |
| 2,826,424 | 3/1958 | Erickson | 272/33 A |
| 3,110,047 | 11/1963 | Bringman | 272/56 |
| 3,279,794 | 10/1966 | Jenkins | 272/56 |
| 3,295,847 | 1/1967 | Matt | 272/96 |
| 3,581,328 | 6/1971 | Smith | 441/67 |
| 3,586,321 | 6/1971 | Gehrke | 272/146 |
| 3,604,722 | 9/1971 | Boley | 272/46 |
| 3,649,007 | 3/1972 | Thomas | 272/114 |
| 3,694,837 | 10/1972 | Von Norring | 272/1 B |

OTHER PUBLICATIONS

CLEO Learning Aids—Cleveland, Ohio, p. 93.

*Primary Examiner*—Richard J. Apley
*Assistant Examiner*—S. R. Crow
*Attorney, Agent, or Firm*—Robert B. Chickering; Glen R. Grunewald

[57] ABSTRACT

A solid, rigid foam device having a continuous outer skin, a flat, circular upper surface that merges smoothly into a symmetric, oblated spherical surface, the upper surface having four, spaced, shallow indentations around its periphery and a number of anchor points that do not extend above the flat surface, the anchor points typically being nuts embedded in the foam plastic body.

5 Claims, 4 Drawing Figures

EXERCISE DEVICE FOR PHYSICAL THERAPY

CROSS REFERENCE

This application is a continuation-in-part of copending application Ser. No. 458,743 filed Mar. 2, 1983 and entitled AN EXERCISING DEVICE FOR FITNESS, PHYSICAL THERAPY, SPORTS, now abandoned.

FIELD OF THE INVENTION

This invention is in the field of exercise devices useful in physical therapy and for maintaining muscle tone.

BACKGROUND OF THE INVENTION

Devices used in physical therapy for working with disabilities and exercising are available in a variety of styles. Many of these devices include motors, springs, levers and platforms among other things.

One type of device that is frequently used is dish-shaped. The user stands, sits or kneels in it and exercises or develops balance and coordination by creating rocking motions. These devices usually have means by which the user maintains his or her position in it and those means usually are handles that the hands can grasp and footholds into which feet can be thrust. Other devices have eye bolts protruding from their surfaces to hold ropes or straps or they have other devices that the user can grasp. Dish-shaped exercise devices frequently have sharp edges or at least hard edges, and if the device is strong enough to maintain its structural integrity in use it is heavy.

In addition, prior devices are designed for use in a particular orientation or environment. Devices with rounded bottoms are intended to have the rounded bottoms supported on the floor and devices used for floatation do not have sufficient strength to be stepped or jumped upon if used out of the water. As a result, for each environment a differnt device is required.

SUMMARY OF THE INVENTION

This invention is an exercise device useful in physical therapy that obviates or greatly mitigates the above-noted problems. This invention is a one-piece, rigid foam device having a continuous outer skin that is impervious to liquids. The device is lighter than its own volume of water and accordingly it floats.

The device has two major surfaces. One surface is shaped as a symmetric oblate spheroidal segment and the other is a substantially flat circular surface. The two surfaces are joined at their circular edges in a smooth, rounded joint. The flat surface has no features extending above it and it has no abrupt contours. The flat surface has four, shallow indentations, preferably elliptical in shape, spaced close to the periphery of the flat surface and located one in each quadrant. The elliptical indentations are also positioned with their long axes running circumferentially of the circular surface in which they are formed. The indentations mostly are useful to locate hands and feet during use, but they also aid the user to hold his or her position on the device.

The device also includes a number of anchor means embedded in the foam plastic body so that no portion of the anchor means extends above the flat surface. The anchor means typically are embedded nuts which are accessible through small holes in the flat surface. The anchor means are required to attach auxiliary equipment to the device of the invention when such equipment is needed, but to preserve the smooth, safe exterior surface of the device when such equipment is not used.

The device can be used with the rounded side down for exercises generally involving rocking, tilting or balancing with the user standing, kneeling, crouching, sitting or lying on the flat surface. The device can also be used with the user in a chair manipulating the device with his or her feet while it is positioned in front of the chair with the rounded surface down. The device also may be used with the user positioned in a chair and the device on a table whereby the user manipulates the device by movement of his or her hands and arms for exercise, to gain skills with particular movements or to improve coordination.

The device of this invention may also be used with the flat side vertical as a back support while the user is sitting. It may also be used as a float while the user is in the water and can be used in beneficial aquatic exercises such as pushing the device of this invention under water against the floatation force that it produces or manuevering it with arms or legs while it is in the water and the user is sitting on the side of a pool.

The device of this invention may also be used with useful accessories connected to the anchor means. For example, flat headed bolts or eye bolts may be attached to the device which then can be connected to ropes, straps, handles or other means to adapt the device of this invention for particular beneficial uses.

DETAILED DESCRIPTION OF THE INVENTION

Figure 1:
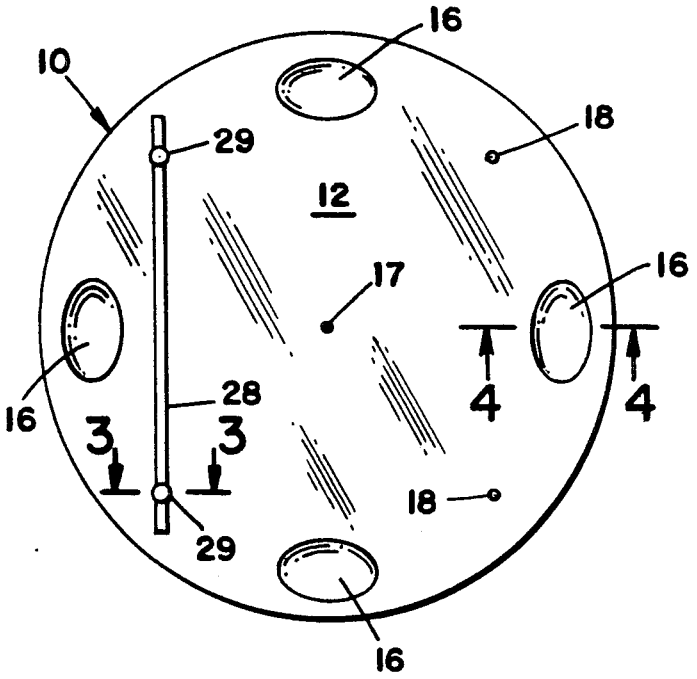
FIG. 1 is a top view of a device embodying this invention.
Figure 2:
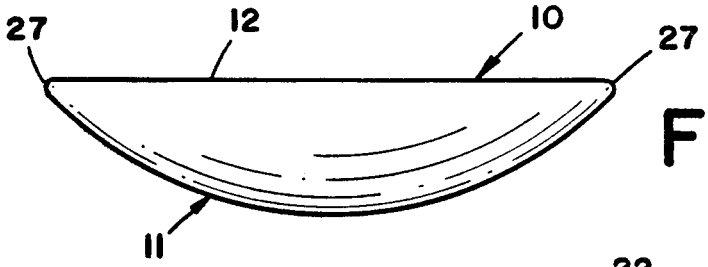
FIG. 2 is a side view of FIG. 1.

The drawings illustrate a particularly desirable embodiment of the invention. The device illustrated in the drawings is generally designated 10 and it includes a first surface 11 that is in the form of a segment of a symmetric, oblate spheroid. The second surface of the device is a substantially flat surface 12. The device is constructed of rigid foam 13 preferably having a continuous skin 15 completely surrounding it. The skin 15 will preferably have a smooth, although not slippery, outer surface. Thus, the outer surface of skin 15 should have sufficient texture to prevent it from being slick but not enough texture to mar a floor or a table upon which the device is supported during use.

The device illustrated in the drawings has four shallow indentations 16 that are made integral with the surface and have rounded, unaggressive edges that merge into upper surface 15. Indentations 16 are spaced so that one is in each quadrant of the circular upper surface 12 although they need not necessarily be spaced equidistant from each other.

Figure 3:
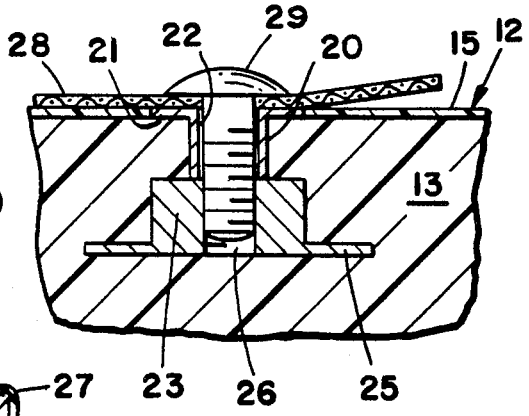
FIG. 3 is a partial cross-section taken along the line 3—3 of FIG. 1.

The device illustrated in the drawings is provided with five anchor points which are best seen in FIG. 3. These include a center anchor point 17 and four peripheral anchor points 18. Although the anchor points do not protrude above the upper surface 12 they do provide means for connecting auxiliary equipment to the device. One of the anchor points 18 is illustrated in FIG.

3 but it is contemplated that all of anchor points 17 and 18 are constructed in the same manner. The anchor points as illustrated include a grommet-like member 20 that has an upper flange 21 that lies flush with the upper surface of surface 12 and a cylindrical portion 22 extending downwardly through the rigid foam 13. The cylindrical portion 22 butts against a nut 23 that terminates in a integral flange 25 that extends deeply into the rigid foam 13. Nut 23 has a threaded center hole 26 that is coaxial with cylindrical portion 22 but smaller in diameter. The nut 23 and its integral flange 25 are embedded deeply enough into the rigid foam 13 so that if a bolt is screwed into threaded hole 26 to secure a handle, the device could be lifted and even could resist force caused by pulling without the bolt and flange combination breaking loose from the foam. It is evident that any useful auxiliary equipment may be screwed into the anchor points, that any number of anchor points may be provided, and that means other than the illustrated threaded fasteners may be employed to secure the auxiliary equipment so long as the anchor points do not protrude above the flat surface 15 and do not, themselves, provide a dangerous or hostile feature such as by being large enough to catch a toe or a finger of a user.

Figure 4:
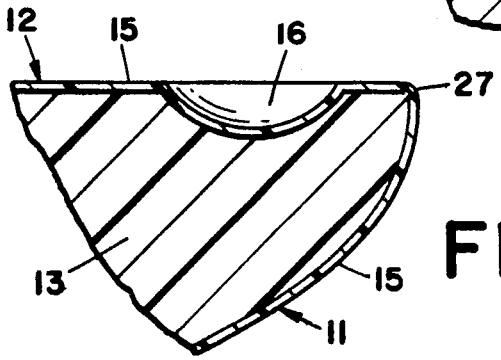
FIG. 4 is a partial cross-section taken along the line 4—4 of FIG. 1.

As best seen in FIG. 4, although surface 12 is essentially flat, it merges with a smooth rounded corner 27 into rounded surface 11 to prevent or mitigate injury to users by being cut, by having skin abrated, or by having concentrated force if the device fell, for example on the foot of a user. The device as illustrated may be made in any useful dimension, for example it may be made 3 to 4 feet in diameter if the user is to stand, sit or crouch on it to produce rocking or tilting exercises, it may be made one to three feet in diameter if the user is to manipulate hands or feet while sitting in a chair and employing the device or if it is to be used as a floatation device or an aquatic exercise tool. The device also may be used as a toy and be made the appropriate size, for example, if it is to be used by being towed behind a boat or as a sled or as a support on a swing that is held by a rope to an eye bolt anchored in anchor point 17.

The device may be made by any of the known methods for producing foam plastic objects. It is readily made by introducing foamable plastic into a closed mold having a cavity the size and shape of the desired object. Methods for producing foam plastic articles with a continuous skin are known to the art and any of those means may be used. It is evident that the article should be made of a material that is rigid enough and strong enough to resist the forces it will experience in use and selection of the appropriate plastic material is known to the art.

The device of this invention when used without auxiliary equipment, presents no surfaces or features that are sharp, hard or hostile. It may be used on a floor with the rounded side down or with the flat side down without marring the floor or other finished surfaces on which it is used. In its form without auxiliary equipment it is useful to exercise individual portions of the body or even the entire body. For example, one could sit on the flat surface 12 placing ones feet on the floor and ones hands in opposite indentations 16 and move the body to create a rocking motion. This is particularly useful to improve a person's coordination and to create gentle uses of muscles. Rocking the device of this invention is very non-threatening to a user because the user is close to the floor and will not fear falling and because the user is not in the vicinity of threatening mechanical devices such as levers, springs, motors or the like. The device rocks readily even when on a soft carpet or mat and the user can select the degree of energ and accordingly the amount of displacement during the rocking exercise so that the user feels that he or she is in control. Rocking or tilting exercises can also be accomplished with the user crouching or kneeling on surface 12 or standing with his or her feet in diametrically opposed indentation 16.

If the device of this invention is employed with flat surface 12 on the floor, the user can sit on the rounded surface or place the small of his back at the apex of the rounded surface and in that position exercise legs or arms or even the back. The user may also execute repetitive exercises including positioning himself or herself in a sitting position at the top of the rounded surface and sliding to the floor.

Useful auxiliary equipment may be connected to the device of this invention through the anchor points. Straps, tapes or ropes may be anchored between adjacent or opposite anchors 18 to provide a handle-type hand hold for a user or a safety strap across the users lap. Straps may be anchored to anchor points 18 with bolts having shallow round heads on them which may be tightened with fingers or provided with slots for a coin or screw driver whereby the elements driven into the anchor points would present no abrupt, threatening or hazardous surfaces. The straps may be employed for more vigorous exercises or they may be employed when using the device in an aquatic environment so that the user will have a sure grasp to the device and need not worry about losing ones grasp on the device and having it float away.

For even more energetic use, eye bolts may be employed in the anchor points 18 and ropes connected to them so that the user can stand upon the surface 12 and vigorously tilt and rock the device while maintaining his or her balance with one or more anchored ropes. The auxiliary devices may also be used when this invention is employed as a toy, for example by suspending it from an eye bolt in anchor point 17 to be used as a swing seat or to provide handle-type element through anchor points 18 and means to connect it to a boat. Handles may also be desired when the device is used to slide downhill on grass or snow and for carrying means or storage.

Although the device of this invention may be used with protruding and hostile elements such as eye bolts and handles, it is evident that the use of such elements is optional and temporary.

What is claimed is:

1. An exercise device comprising a one-piece rigid foam element, said element being lighter in weight than its own volume of water, having a substantially continuous skin, having a first surface shaped as a symmetric oblate spheroid segment, having a second substantially flat circular surface merged smoothly into said first surface around its circumference, said second surface including four, shallow indentations for positioning the hands and feet of a user spaced closely to its perimeter with one indentation in each quadrant, and at least two anchor means that do not protrude above said substantially flat surface, said first and second surfaces being free from abrupt contour features.

2. The device of claim 1 wherein said shallow indentations are elliptical with their long axes circumferential.

3. The device of claim 1 wherein said anchor means includes a nut embedded in said rigid foam.

4. The device of claim 1 having auxiliary equipment secured to said anchor means.

5. The device of claim 4 wherein said auxiliary means includes a strap.

* * * * *